United States Patent [19]

Muehlberger

[11] Patent Number: 4,912,361

[45] Date of Patent: Mar. 27, 1990

[54] PLASMA GUN HAVING IMPROVED ANODE COOLING SYSTEM

[75] Inventor: Stephan E. Muehlberger, San Clemente, Calif.

[73] Assignee: Electro-Plasma, Inc., Irvine, Calif.

[21] Appl. No.: 220,233

[22] Filed: Jul. 18, 1988

[51] Int. Cl.[4] ..... H01J 1/02; H01J 7/24; H01J 27/04

[52] U.S. Cl. ..... 313/30; 313/35; 313/359.1; 313/231.31

[58] Field of Search ..... 313/30, 32, 35, 36, 313/359.1, 363.1, 231.31

[56] References Cited

U.S. PATENT DOCUMENTS

| | | | |
|---|---|---|---|
| 3,390,292 | 6/1968 | Perugini | 313/35 X |
| 3,449,628 | 6/1969 | Cann et al. | 313/30 X |
| 4,328,257 | 5/1982 | Muehlberger | 427/34 |

*Primary Examiner*—Kenneth Wieder
*Attorney, Agent, or Firm*—Scherlacher, Mok & Roth

[57] ABSTRACT

In a plasma gun in which a plasma power source coupled between an anode and a cathode partly disposed within a central plasma chamber within the anode combines with the introduction of inert gas in the region of the cathode to form a plasma arc and a resulting plasma stream flowing from the anode, an improved cooling system is provided for the anode. Cooling fluid in the form of water from a booster pump is introduced generally tangentially into an annular cooling chamber formed between a cylindrical outer surface of the anode and a housing in which the anode is mounted. A helical groove formed by a set of threads in the outer cylindrical surface of the anode provides a spiral flow path for the cooling water within the annular cooling chamber such that the cooling water advances axially along the length of the anode as it flows around the outside of the anode. This enhance the heat exchanging ability of the cooling water and thereby the cooling of the anode, particularly in the case of small plasma guns whose miniaturized cooling passages and other scaled-down dimensions make anode cooling difficult. The cooling water eventually exits the annular chamber for return to the booster pump via an outlet passage disposed generally in line with the central axis of the anode to encourage multiple revolutions of the cooling water within the annular chamber before exiting.

10 Claims, 5 Drawing Sheets

PLASMA GUN HAVING IMPROVED ANODE COOLING SYSTEM

BACKGROUND OF THE INVENTION

1. Field of the Invention

The present invention relates to plasma guns in which the application of a plasma power source in combination with the introduction of a substantially inert gas at a cathode produces a plasma arc and a resulting plasma stream within an anode in which the cathode is partly disposed, and more particularly to cooling systems for the anode.

2. History of the Prior Art

Plasma guns are known in which a plasma power source coupled between an anode and a cathode combines with the introduction of a substantially inert gas in the region of the cathode to produce an arc within a central plasma chamber within the anode and a plasma stream flowing from the anode. The plasma stream may be directed onto a work piece or other target which is typically coupled to the anode by power supplies to provide a transfer arc. The plasma stream may be used to heat the target. Introduction of powdered material such as powdered metals into the central plasma chamber of the anode causes the metallic powder to be carried to and coated on the target. The operation of the plasma gun may be carried out in atmosphere, although for many applications it is preferred that a vacuum source be coupled to a closed chamber for the plasma gun to provide a low pressure environment and a supersonic plasma stream. Such a plasma system is described in U.S. Pat. No. 4,328,257 of Muehlberger et al, which patent issued May 4, 1982, is entitled "System and Method for Plasma Coating", and is commonly assigned with the present application.

During operation of plasma guns, considerable heat is produced within the gun. A substantial amount of heat is generated in the region of the cathode, typically requiring that a cathode cooling system be provided to circulate water or other cooling fluid in the region of the cathode.

An even greater heating problem occurs in the region of the anode where the plasma arc occurs and the resulting plasma stream is formed within the central plasma chamber. Water or other cooling fluid must be circulated within the gun in the region of the anode to provide cooling of the anode. Anodes are typically of rounded or generally cylindrical configuration, and the cooling water or other cooling fluid is typically delivered to one or more annular passages surrounding the anode where the water circulates before being removed from the gun. Heat from the anode is transferred to the contacting water, and the water as so heated is removed from the gun.

Circulating water systems have proven to be reasonable effective in cooling the anodes of plasma guns, particularly in the case of arrangements where the cooling water is forced to undergo at least a partial revolution around the anode before exiting from the gun. However, the problem of maximizing heat transfer from the anode to the cooling water to provide effective anode cooling is magnified in certain situations such as in the case of plasma guns of relatively small size. So called "mini guns" which measure only a few inches in length and width are commonly used to perform plasma spraying in confined areas such as on the insides of pipes. The mechanics of circulating water or other cooling fluid within the confined spaces of the anode cooling systems of such mini guns is such that effective heat transfer is made difficult. Consequently the anode cooling systems in most such mini guns are of limited effectiveness, and operation of the plasma gun must be carefully monitored to detect overheating. Overheating can occur quickly as the small amounts of cooling water within the confined passages of the anode cooling system may slow or otherwise stagnate long enough to reach the boiling point. As the water begins to boil, it both expands and emits gas, so that continued cooling action is greatly impaired. Such condition must be quickly detected and use of he gun terminated to minimize damage to the gun.

Accordingly, it would be desirable to provide an improved anode cooling system for plasma guns. In particular, it would be advantageous to provide an anode cooling system of increased efficiency and effectiveness and which is particularly well suited for difficult cooling situations such as in the case of mini guns.

BRIEF DESCRIPTION OF THE INVENTION

The present invention provides an improved anode cooling system within a plasma gun. Anode cooling systems in accordance with the invention cause water or other cooling fluid introduced into an annular passage adjacent the anode to advance along the length of the anode as the fluid flows around the anode. This spiraling action of the cooling fluid has been found to significantly improve the heat transfer and thereby the cooling action provided by the presence of the cooling fluid. In particular, the spiral flow path of the cooling fluid promotes continuous motion of the fluid relative to the anode so that the tendency of the cooling fluid to overheat or boil is greatly reduced. At the same time outlet passage means for the cooling fluid is oriented relative to the annular passage surrounding the anode to promote at least several revolutions of the cooling fluid before exiting. In this manner heat transfer from the anode to the contacting cooling fluid is further enhanced.

In a specific example of a plasma gun anode cooling system in accordance with the invention, the anode is of generally cylindrical configuration and is mounted within a surrounding housing so as to form an annular passage with the housing at a generally cylindrical outer surface of the anode. Cooling water from a water booster pump flows via a conduit to an inlet passage in the housing which is generally tangentially oriented relative to the adjoining annular passage to promote rotational movement of the cooling fluid about the annular passage. An outlet passage formed within the housing and which is coupled to the water booster pump via a conduit is in general alignment with the central axis of the anode, and as thus positioned encourages multiple revolutions of the cooling water before the cooling water exits via the outlet passage.

A plasma power source is coupled between the anode and the cathode to provide the potential difference necessary to produce a plasma arc within the central plasma chamber within the anode in the presence of inert gas at the cathode. Transfer arc power supplies are coupled between the anode and a workpiece or other target to provide a transfer arc therebetween where desired. A powder passage within the anode is coupled via a conduit to a powder feed mechanism to introduce powders of metal or other selected materials into the central plasma chamber within the anode. The cathode is provided with its own cooling system which utilizes circulating water from the same water booster pump that supplies the anode cooling system. The cathode is also provided with an arrangement for introducing substantially inert gas from a source of the gas onto the cathode in the region of the central plasma chamber of the anode.

BRIEF DESCRIPTION OF THE DRAWINGS

A better understanding of the invention may be had by reference to the following specification in conjunction with the accompanying drawings, in which.

DETAILED DESCRIPTION OF THE INVENTION

Figure 1:
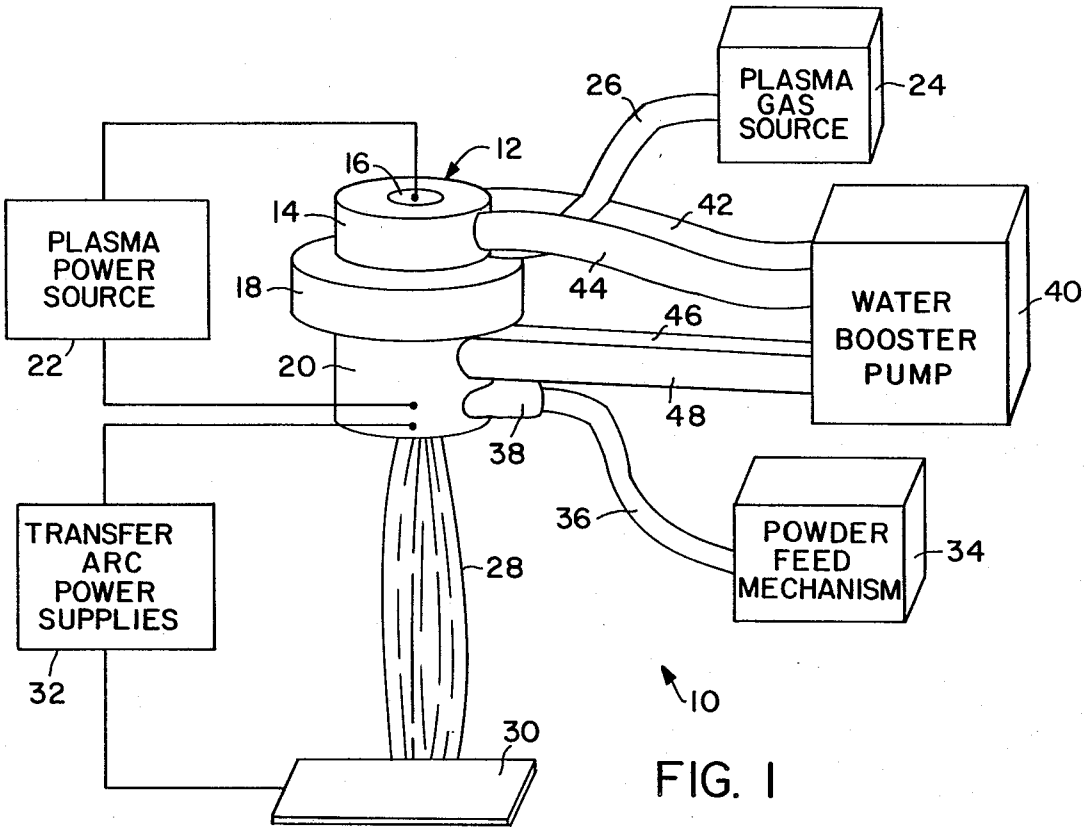
FIG. 1 is a perspective view of a plasma system having a plasma gun with an improved anode cooling system in accordance with the invention.

FIG. 1 depicts a plasma system 10 having a plasma gun 12. As described in detail hereafter, the plasma gun 12 includes an improved anode cooling system in accordance with the invention. Apart from the improved anode cooling system, the plasma gun 12 is of conventional design and functions in conventional fashion. Accordingly, with the exception of the anode cooling system, the plasma gun 12 is only briefly described herein.

The plasma gun 12 includes a cathode holder assembly 14 having a cathde 16 mounted therein. An anode mounting ring 18 interlocks with a cathode mounting ring (not shown in FIG. 1) to secure an anode housing 20 to the cathode holder assembly 14. The anode housing 20 houses an anode (not shown in FIG. 1).

A plasma power source 22 comprises a DC power supply having the opposite terminals thereof coupled in appropriate polarity to the cathode 16 and to the anode of the plasma gun 12. A plasma gas source 24 provides a substantially inert gas such as argon to the plasma gun 12 via a gas supply line 26 which introduces the gas into the cathode holder assembly 14. As described hereafter in connection with FIG. 2, the cathode holder assembly 14 is configured to introduce the gas onto the cathode 16. The presence of the substantially inert gas at the cathode 16 combines with the potential difference provided by the plasma power source 22 to provide a plasma arc and a resulting plasma stream 28 within the anode housed by the anode housing 20. The plasma stream 28 extends from a lower end of the plasma gun 12 to a workpiece or other target 30. Transfer arc power supplies 32 may be coupled between the anode housed by the anode housing 20 and the target 30 to provide a transfer arc therebetween.

The plasma system 10 of FIG. 1 includes a powder feed mechanism 34 coupled to the plasma gun 12 via a powder feed line 36 and a powder fitting 38. The powder fitting 38 is coupled to a lower portion of the anode housing 20. As described hereafter in connection with FIG. 2, powder provided to the powder fitting 38 from the powder feed mechanism 34 via the powder feed line 36 flows through a powder passage within the anode into a central plasma chamber where the powder mixes with the plasma stream 28 for delivery thereof to the target 30. The powder which is melted within the plasma stream 28 forms a coating on the target 30.

The plasma system 10 includes a water booster pump 40 for supplying cooling water to the plasma gun 12. After the cooling water is circulated through the plasma gun 12, the cooling water is returned to the water booster pump 40. A water inlet line 42 coupled between the water booster pump 40 and the cathode holder assembly 14 supplies cooling water to cool the cathode holder assembly 14 and the cathode 16 as described hereafter in connection with FIG. 2. Upon circulation of such cooling water through the cathode holder assembly 14, the water is returned to the water booster pump 40 va a water return line 44. The water booster pump 40 is also coupled via a water inlet line 46 to supply cooling water to the anode housing 20 for cooling the anode in a manner described in detail hereafter in connection with FIGS. 2–9. Such cooling water eventually exits the anode housing 20 and is returned to the water booster pump 40 via a water return line 48.

Figure 2:
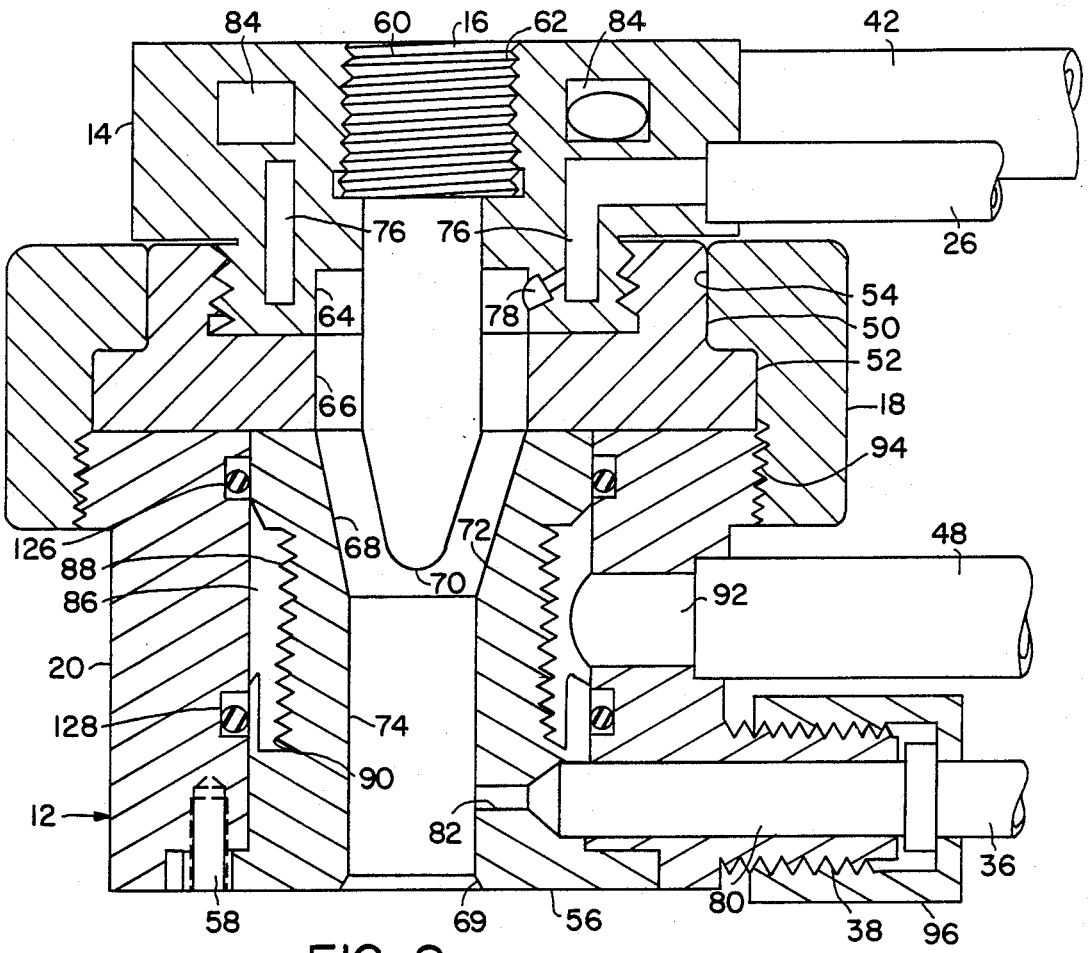
FIG. 2 is a sectional view of the plasma gun of FIG. 1.

Referring to FIG. 2 the cathode holder assembly 14 is threaded to a cathode mounting ring 50 at the lower end thereof. The cathode mounting ring 50 is provided with an outwardly extending flanged portion 52 which interlocks with an opposing inwardly extending flanged portion 54 of the anode mounting ring 18. The anode mounting ring 18 is threaded to an upper portion of the anode housing 20 which houses an anode 56 therein. The anode 56 is mounted within the anode housing 20 such as by bolts 58, one of which is shown in FIG. 2.

As shown in FIG. 2 the cathode 16 has an upper threaded end 60 thereof which is received within a mating threaded aperture 62 within the cathode holder assembly 14. The cathode 16 extends downwardly from the upper threaded end 60 thereof through a central aprture 64 in a lower end of the cathode holder assembly 14, through a central aperture 66 in the cathode mounting ring 50 and into a central aperture 68 within and extending along the axis of elongation of the anode 56. The cathode 16 terminates in a cathode tip 70 within a partially conical upper portion 72 of the central aperture 68. At the lower end of the upper portion 72, the central aperture 68 forms a generally cylindrical aperture 74 throughout the rest of the length of the anode 56. The central aperture 68 of the anode 56 forms a central plasma chamber within the anoe 56.

Inert gas supplied by the gas supply line 26 to the cathode holder assembly 14 enters an annular passage 76 within the cathode holder assembly 14. From the annular passage 76, the gas flows through a plurality of apertures 78 spaced about a lower portion of the annular passage 76 to the central aperture 64 at the bottom of the cathode holder assembly 14. From the central aperture 64, the gas flows through the central aperture 66 in the cahhode mounting ring 50 and into the partially conical upper portion 72 of the central aperture 68 where it surrounds the cathode tip 70. The gas combines with the poetical difference supplied from the plasma power source 22 to provide a plasma arc between the cathode 16 and the anode 56. The plasma stream 28 (illustrated in FIG. 1) is created within the central aperture 68 from which it flows through a nozzle 69 formed by the lower portion of the generally cylindrical aperture 4 to the outside of the plasma gun 12.

Powder to be introduced into the plasma stream 28 is provided by the powder feed mechanism 34 via the powder feed line 36 as previously described in connection with FIG. 1. The powder from the powder fed line 36 enters the anode housing 20 at the powder fitting 38 via a power passage 80 in the anode housing 20. From the powder passage 80, the powder flows through a smaller powder delivery passage 82 in the anode 56 and into the generally cylindrical aperture 74 of the central plasma chamber. It is here that the powder is entraind into the plasma stream 28 for delivery to and deposit on the target 30.

As described in connection with FIG. 1, the cathode 16 of the plasma gun 12 is cooled by water from the booster pump 40 supplied via the water inlet line 42. The water inlet line 42 is coupled to an annular chamber 84 within the cathode holder assembly 14 as is the water return line 44 (not shown in FIG. 2). Both the water inlet line 42 and the water return line 44 are oriented generally tangentially relative to the annular chamber 84. This encourages the cooling water entering the annular chamber 84 from the water inlet line 42 to flow around the circular path of the annular chamber 84 before exiting via the water return line 44.

As previously described in connection with FIG. 1, the plasma gun 12 is provided with an anode cooling system which receives cooling water via the water inlet line 46 from the water booster pump 40. Such water is returned to the water booster pump 40 via the water return line 48 which is shown in FIG. 2. Cooling water provided by the water inlet line 46 is introduced into an annular chamber 86 formed at the interface between the anode 56 and the anode housing 20 among a portion of the length of the anode 56.

In accordance with the invention cooling water entering the annular chamber 86 is directed into a spiral flow path so that the water advances axially along the length of the anode 56 as it moves around the annular chamber 86. The spiral flow path is provided by a helical groove 88 formed in a generally cylindrical outer surface 90 of the anode 56 at the inner wall of the annular chamber 86. As described hereafter, most of the cooling water within the annular chamber 86 makes several revolutions therein before exiting via a return passage 92 in the anode housing 20 to the water return line 48.

Figure 3:
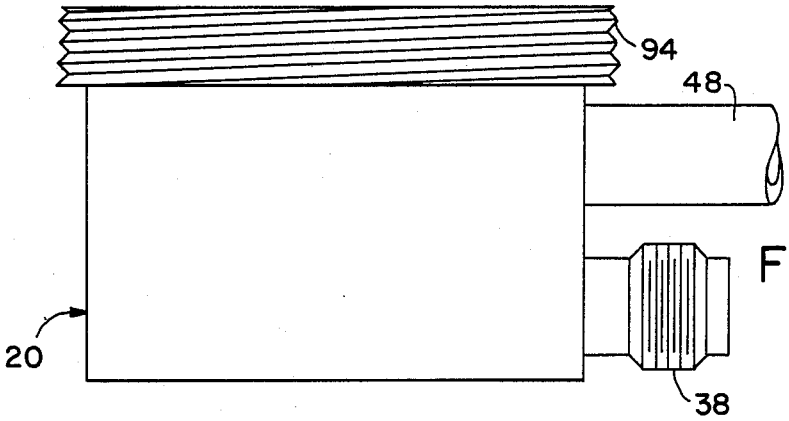
FIG. 3 is a front elevational view of the anode housing of the plasma gun of FIG. 2.

FIG. 3 is a front elevational view of the anode housing 20 of the plasma gun 12 of FIG. 2. As shown therein the anode housing 20 is ff generally cylindrical configuration and has a threaded upper portion 94 thereof of slightly larger diameter than the remainder of the anode housing 20. The threaded upper portion 94 is threaded to the anode mounting ring 18 to couple the anode ousing 20 to the anode mounting ring 18. As shown in FIG. 3 the water return line 48 is coupled to the side of the anode housing 20, as is the powder fitting 38. The water inlet line 46 shown in FIG. 2 but hidden from view in FIG. 3 by the water return line 48 is also coupled to the side of the anode housing 20 slightly spaced apart from and approximately at the same height as the water return line 48. A threaded outer portion of the powder fitting 38 receives a collar 96 shown in FIG. 2 to couple the powder feed line 36 to the powder passage 80 within the anode housing 20.

Figure 4:
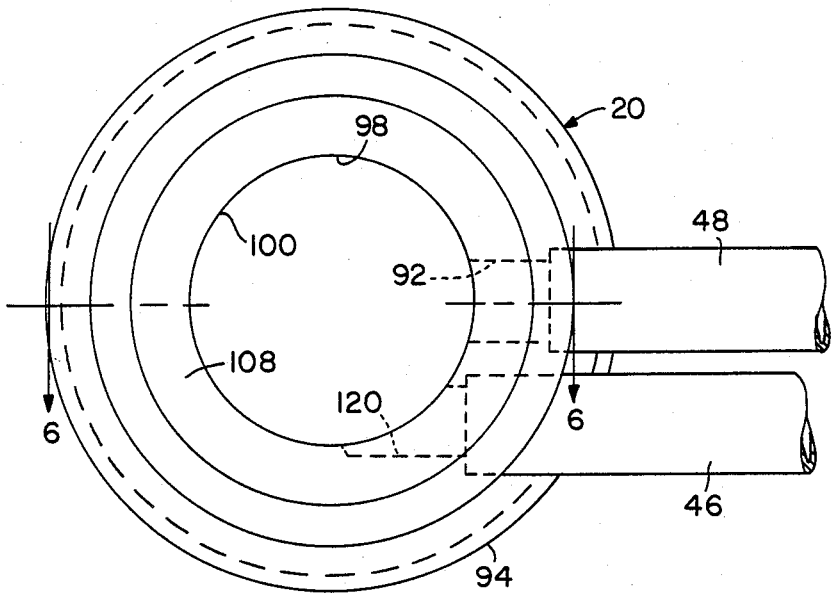
FIG. 4 is a bottom view of the anode housing of FIG. 3.
Figure 5:
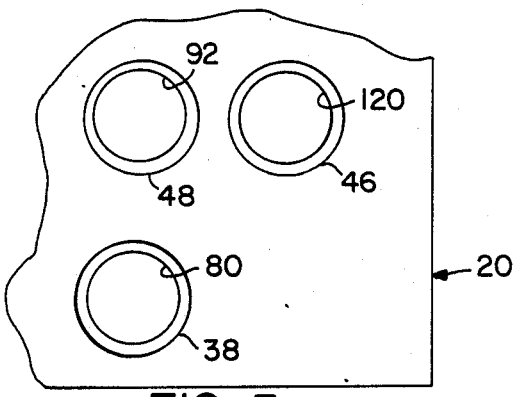
FIG. 5 is a partial side elevational view of the anode housing of FIG. 3 illustrating the location of the water lines and the powder injection fittings.

Referring to FIG. 4 the anode housing 20 has a generally cylindrical central aperture 98 extending therethrough and having a wall 100. The wall 100 receives the anode 56 to mount the anode 56 within the anode housing 20. As such, the wall 100 forms an outer wall of the annular chamber 86.

Figure 8:
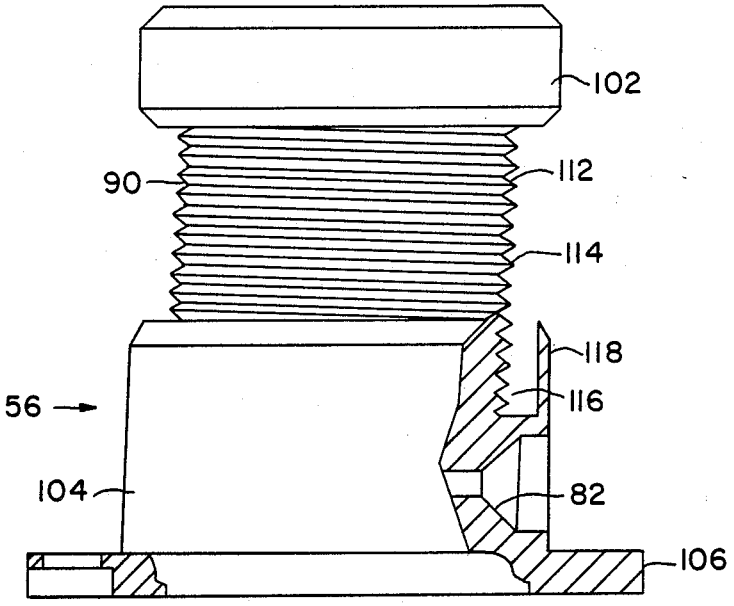
FIG. 8 is a front elevational view of the anode of the plasma gun shown in FIG. 2, which is partly broken away to illustrate some of the details thereof.
Figure 9:
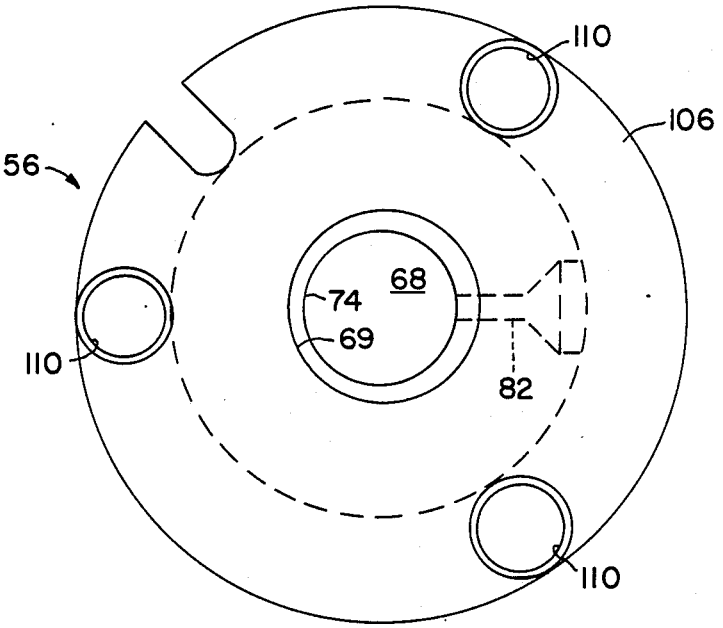
FIG. 9 is a bottom view of the anode of FIG. 8.

The anode 56 which is shown in FIGS. 8 and 9 is of generally cylindrical configurtion and has separated upper and lower cylindrical portions 102 and 104 which are received by the wall 100 when the anode 56 is moutted within the anode housing 20. The lower cylindrial portion 104 of the anode 56 terminates in an annular flange 106 which is received within a mating annular groove 108 at the bottom of the anode housing 20 when the anode 56 is mounted within the anode housing 20. The annular grove 108 extends into the anode housing 20 between the bottom of the anode housing 20 and the wall 100. As previously noted in connection with FIG. 2, the anode 56 is held i place within the anode housing 20 by the bolts 58. The bolts 58 extend through the annular flange 106 of the anode 56 and into the anode housing 20. As shown in FIG. 9 the annular flange 106 is provided with three generally equidistantly spaced apertures 110 therein, each of which receives one of the bolts 58.

As shown in FIG. 8 the anode 56 has an intermediate cylindrical portion 112 thereof disposed between the upper and lower cylindrical portions 102 and 104 and having a smaller diameter so as to be recessed inwardly from the cylindrical portions 102 and 104. The helical groove 88 is disposed within the generally cylindrical outer surface 90 of the intemmediate portion 112, and in the present example comprises a set of left-hand threads 114. As such, the set of left-hand threads 114 defines a spiral flow path for the cooling water which advances axially along the length of the anode 56 from the upper cylindrical portion 102 to the lower cylindrical portion 104 as the spiral flow path encircles the intermediate portion 112. The set of left-hand threads 114 extends partly into the lower cylindrical portion 104 here an annular recess 116 is formed within an outer wall 118 of the loeer cylindrical portion 104 at the upper end thereof.

Figure 7:
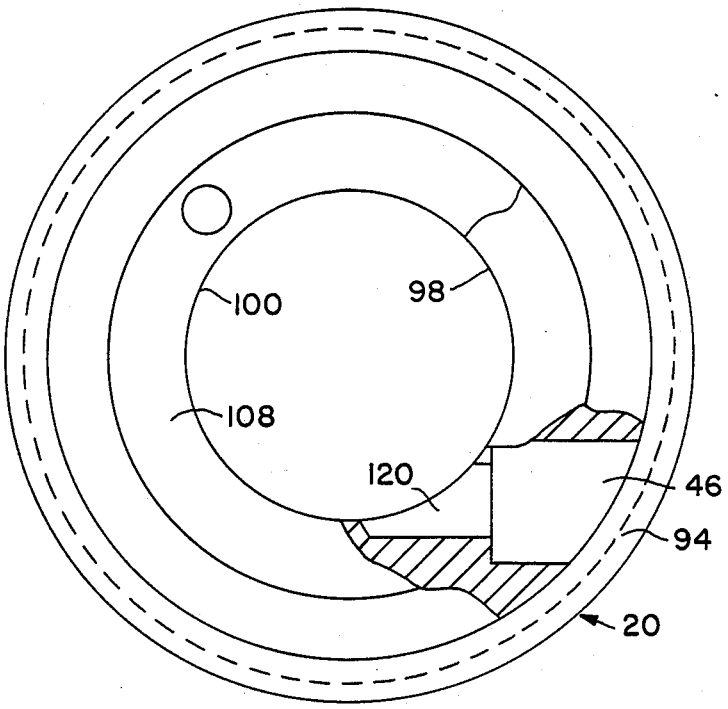
FIG. 7 is a bottom view of the anode housing of FIG. 3 similar to the view of FIG. 4 but partially broken away to show the position of the cooling water inlet passage.

The water inlet line 46 is coupled to an inlet passage 120 in the anode housing 20. The inlet passage 120 which is shown in dotted outline in FIG. 4 and in soli outline in the broken away portion of FIG. 7 is generally tangettially disposed relative to the annular chamber 86. This encourages the entering cooling water to flow around the annular chamber 86 in a clockwise direction as viewed in FIGS. 4 and 7. A single inlet passage 120 is shown and described herein for purposes of illustration only. Alternatively, two or more inlet passages can be used to introduce the cooling water into the spiral flow path in the annular chamber 86.

Whereas the water inlet line 46 and the inlet passage 120 are generally tangentially oriented relative to the annular chamber 86, the water return line 48 and the adjoining return passage 92 within the anode housing 20 are generally in alignment with the central axis of the anode housing 20 as shown in FIG. 4. This positioning of the water return line 48 and the associated return passage 92 encourages the cooling water introduced into the annular chamber 86 from the inlet passage 120 to make several complete passes around the circumference of the annular chamber 86 before exiting via the return passage 92 and the water return line 48. Multiple passes by some or all of the cooling water has been found to improve the heat exchange which occurs between the anode 56 and the cooling water.

Figure 6:
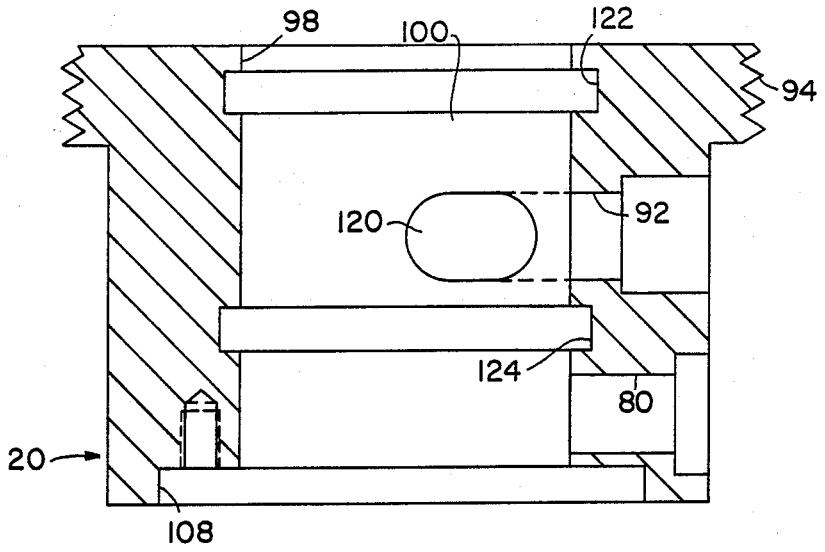
FIG. 6 is a sectional view of the anode housing of FIG. 3 taken along the line 6—6 of FIG. 4.

The manner in which the inlet passage 120 interfaces with the annular chamber 86 at the innrr wall 100 of the node housing 20 is shown in FIG. 6 and in FIG. 7. FIG. 6 also shows that the inner wall 100 of the anode housing 20 is provided with a spaced apart pair of annular recesses 122 and 124 therein. The upper annular recess 122 in adapted to receive a sealing ring 126 which is shown in FIG. 2 and which seats against and seals with the upper cylindrical portion 102 of the anode 56 when the anode 56 is installed within the anode housing 20. The lower annular recess 124 is adapted to receive a sealing ring 128 which is shown in FIG. 2 and which seats against and seals with the outer wall 118 at the upper end of the lower cylindrical portion 104 of the anode 56 when the anode 56 is installed within the anode housing 20.

With the water inlet line 46 and the inlet passage 120 being tangentially disposed relative to the annular chamber 86 as previously described, the incoming cooling water from the water booster pump 40 enters and circulates around the annular chamber 86 in a clockwise direction as viewed in FIG. 4. As the cooling water moves around the annular chamber 86, the set of left-hand threads 114 on the generally cylindrical outer surface 00 of the intermediate portion 112 of the anode 56 causes the cooling water to slowly advance toward the bottom of the anode 56 as viewed in FIG. 8 and toward the bottom of the plasma gun 12 as viewed in FIG. 4.

The axial advancement of the cooling water along the anode together with the circular motion thereof has been found to be very effective in keeping the portion of the water which contacts the generally cylindrical outer surface 90 of the anode 56 in constant motion. As previously noted, any tendency for the cooling water at the interface with the anode 56 to slow substantially or even stop can quickly lead to overheating. The cooling water eventually exits the annular chamber 86 via the return passage 92 and the water return line 48, but only after at least a substantial portion thereof has undergone several revolutions around the annular chamber 86 as provided for by the non-tangential disposition of the return passage 92 and the water return line 48.

While the invention has been particularly shown and described with reference to a preferred embodiment thereof, it will be understood by those skilled in the art that various changes in form and details may be made therein without departing from the spirit and scope of the invention.

What is claimed is:

1. A plasma gun comprising the combination of:

a housing;

a cathode mounted within the housing;

an anode mounted within the housing, the anode being of generally circular configuration and having an axis of elongation;

a source of cooling fluid; and means for circulating cooling fluid around the anode in a circular pattern while simultaneously advancing the cooling fluid axially along the anode to provide cooling of the anode, the means for circulating comprising a helical groove disposed about the generally circular configuration of the anode.

2. The invention set forth in claim 1, wherein the means for circulating cooling fluid includes a cooling fluid inlet conduit disposed adjacent the anode for introducing cooling fluid from the source onto the anode and a cooling fluid outlet conduit disposed adjacent the anode for removing cooling fluid from the anode, the cooling fluid outlet conduit being disposed relative to the anode to encourage multiple revolutions of the cooling fluid around the anode before flowing into the cooling fluid outlet conduit.

3. An arrangement for cooling an anode in a plasma gun comprising the combination of;

an anode;

an annular cooling chamber surrounding a portion of the anode;

a source of cooling fluid;

means for coupling the source of cooling fluid to the annular cooling chamber; and means for defining a helical groove path within the annular cooling chamber.

4. The invention set forth in claim 3, wherein the groove is in an outer surface of the anode within the annular cooling chamber.

5. The invention set forth in claim 4, wherein the anode has a generally cylindrical outer surface and the helical groove comprises a set of threads formed in the cylindrical outer surface of the anode.

6. An anode arrangement within a plasma gun comprising the combination of:

a housing;

a generally cylindrical anode mounted within the housing and having a central plasma chamber therein extending along a central axis of the anode, the anode combining with the housing to define an annular cooling chamber surrounding an outer surface of he anode;

a cooling fluid inlet passage within the housing opening to the annular cooling chamber;

a cooling fluid outlet passage within the housing opening to the annular cooling chamber; and means for defining a helical groove within the annular cooling chamber.

7. The invention set forth in claim 6, wherein the helical groove is formed in the outer surface of the anode.

8. The invention set forth in claim 6, further including a cathode disposed within the central plasma chamber, and a powder delivery passage within the anode opening to the central plasma chamber.

9. The invention set forth in claim 6, wherein the cooling fluid inlet passage is oriented generally tangentially relative to the annular cooling passage and the cooling fluid outlet passage is generally aligned with the central axis of the anode.

10. The invention set forth in claim 9, further including a water booster pump and a pair of conduits cupling the water booster pump to the cooling fluid inlet and outlet passages.

* * * * *

UNITED STATES PATENT AND TRADEMARK OFFICE

CERTIFICATE OF CORRECTION

PATENT NO. : 4,912,361

DATED : March 27, 1990

INVENTOR(S) : Stephan E. Muehlberger

It is certified that error appears in the above—identified patent and that said Letters Patent is hereby corrected as shown below:

ON THE TITLE PAGE

IN THE ABSTRACT:

On the first page of the patent, column 2, line 15, "enhance" should be --enhances--.

Column 2, line 13, before "gun", "he" should be --the--.

Column 3, line 49, "cathde" should be --cathode--.

Column 4, line 50, "aprture" should be --aperture--; and line 60, "anoe" should be --anode--.

Column 5, line 4, "poetical" should be --potential--; line 21, "entraind" should be --entrained--; line 44, "among" should be --along--; line 60, "ff" should be --of--; and line 65, "ousing" should be --housing--.

UNITED STATES PATENT AND TRADEMARK OFFICE

CERTIFICATE OF CORRECTION

PATENT NO. : 4,912,361

DATED : March 27, 1990

INVENTOR(S) : Stephan E. Muehlberger

It is certified that error appears in the above—identified patent and that said Letters Patent is hereby corrected as shown below:

Column 6, line 15, "configurttion" should be --configuration--; line 26, after "held", "i" should be --in--; line 47, "here" should be --where--; line 49, "loeer" should be --lower--; line 53, "soli" should be --solid--; and line 55, "tangettially" should be --tangentially--.

Column 7, line 11, "innrr" should be --inner--; line 12, "node" should be --anode--; and line 35, "00" should be --90--.

IN THE CLAIMS:

Claim 3, column 8, line 26, "path" should be deleted.

Claim 6, column 8, line 43, "he" should be --the--.

UNITED STATES PATENT AND TRADEMARK OFFICE

CERTIFICATE OF CORRECTION

PATENT NO. : 4,912,361

DATED : March 27, 1990

INVENTOR(S) : Stephan E. Muehlberger

It is certified that error appears in the above-identified patent and that said Letters Patent is hereby corrected as shown below:

Claim 10, column 8, line 63, "cupling" should be --coupling--.

Signed and Sealed this

Seventeenth Day of December, 1991

*Attest:*

HARRY F. MANBECK, JR.

*Attesting Officer*

*Commissioner of Patents and Trademarks*